US008113861B2

(12) United States Patent
Shen et al.

(10) Patent No.: US 8,113,861 B2
(45) Date of Patent: Feb. 14, 2012

(54) CARD CONNECTOR

(75) Inventors: Leif Shen, Taoyuan (TW); Paul Wang, Taoyuan (TW); Michel Fonteneau, Le Mans (FR)

(73) Assignee: FCI, Versailles (FR)

( * ) Notice: Subject to any disclaimer, the term of this patent is extended or adjusted under 35 U.S.C. 154(b) by 1063 days.

(21) Appl. No.: 11/666,249

(22) PCT Filed: Oct. 27, 2005

(86) PCT No.: PCT/SG2005/000371

§ 371 (c)(1),
(2), (4) Date: Dec. 17, 2007

(87) PCT Pub. No.: WO2006/046932

PCT Pub. Date: May 4, 2006

(65) Prior Publication Data

US 2011/0151700 A1 Jun. 23, 2011

(30) Foreign Application Priority Data

Oct. 28, 2004 (TW) ..... 93132804 A

(51) Int. Cl.
*H01R 13/62* (2006.01)

(52) U.S. Cl. ..... 439/326

(58) Field of Classification Search ..... 439/326, 439/631, 630, 331, 486, 945, 637
See application file for complete search history.

(56) References Cited

U.S. PATENT DOCUMENTS

| | | | | |
|---|---|---|---|---|
| 5,813,878 | A * | 9/1998 | Kuwata et al. | 439/326 |
| 6,210,193 | B1 | 4/2001 | Ito et al. | 439/326 |
| 6,471,550 | B2 * | 10/2002 | Maiterth et al. | 439/631 |
| 6,869,302 | B2 * | 3/2005 | Bricaud et al. | 439/326 |
| 6,951,472 | B2 * | 10/2005 | Shih | 439/326 |
| 7,029,306 | B2 * | 4/2006 | Bilcauu et al. | 439/326 |

FOREIGN PATENT DOCUMENTS

| | | |
|---|---|---|
| CN | 2650344 Y | 10/2004 |
| EP | 965 937 A1 | 12/1999 |
| EP | 977 139 A1 | 2/2000 |
| EP | 1 204 064 A2 | 5/2002 |

* cited by examiner

*Primary Examiner* — Jean F Duverne
(74) *Attorney, Agent, or Firm* — Harrington & Smith

(57) ABSTRACT

The connector of the present invention includes a base having a plurality of terminals for contacting the card and a cover for holding the card. In an embodiment, the base has two resilient plates extending from the base, each of the plates has a distal end at which an inner hinging portion is formed. The cover has an outer hinging portion engaged with the inner hinging portions to form a hinge such that the cover is pivotally mounted on the base and movable in relation to the base. Each of the resilient plates is L-shaped such that the hinge is deflectable from the base.

10 Claims, 3 Drawing Sheets

CARD CONNECTOR

FIELD OF THE INVENTION

The present invention relates to a card connector, and particularly to a card connector comprising a deflectable hinging portion disposed at the junction between a base and cover of the connector.

BACKGROUND OF THE INVENTION

SIM (Subscriber Identity Module) card readers are frequently used in telephone devices, in particular in so-called cellular phones.

U.S. Pat. No. 5,996,891, which is incorporated herein by reference and thus whose reference numerals are used in this paragraph, discloses a SIM card reader. The card reader comprises a contact support (11) and a cover (12) that is rotatably mounted via two bearing members (13*a*, 13*b*) onto the support (11). To lock a card (1) on the support (11), the support (11) is provided with a cam surface (25) and a shoulder (35). The card (1) is inserted into the cover (12) to at an open position as shown in FIG. 1. While the cover (12) is rotated in a clockwise direction, the cam surface (25) on the support (11) will urge the card (1) to the right, and finally in a closed position a front end of a wing portion (74) of the card (1) will abut on the shoulder. According to the prior art patent, the card (1) can move in relation to the support (11) while it rotates, but the cover (12) cannot move in relation to the support (11).

U.S. Pat. No. 6,210,193, which is incorporated herein by reference and thus whose reference numerals are used in this paragraph, discloses a card reader connector (1). The connector (1) includes an insulative body (2) and a cover (4) pivoted thereon for pivotally moving between an open and a closed position via pivot pins (3). A projecting actuating piece (25) cooperate with engaging piece (16) on the insulative body (2) to form a means for locking the cover (4). According to the prior art patent, the cover (4) cannot move in relation to the support (2).

SUMMARY OF THE INVENTION

An object of the present invention is to provide a connector for connecting a card to a card reader. The connector of the present invention comprises a base having a plurality of terminals for contacting the card, and a cover for holding the card. The base has two resilient plates extending from the base, each of the plates has a distal end at which an inner hinging portion is formed. The cover has an outer hinging portion engaged with the inner hinging portions to form a hinge such that the cover is pivotally mounted on the base and movable in relation to the base.

Each of the resilient plates is L-shaped such that the hinge is deflectable from the base. Besides, each of the resilient plates has a horizontal portion and a vertical portion at which the inner hinging portion extends horizontally.

The various objects and advantages of the present invention will be more readily understood from the following detailed description when read in conjunction with the appended drawings.

DETAILED DESCRIPTION OF THE PREFERRED EMBODIMENTS

In order that those skilled in the art can further understand the present invention, the present invention will be described hereinafter in detail. However, the descriptions and the appended drawings are only used to cause those skilled in the art to understand the objects, features, and characteristics of the present invention, but not to be used to limit the scope and spirit of the present invention defined in the appended claims.

Figure 1:
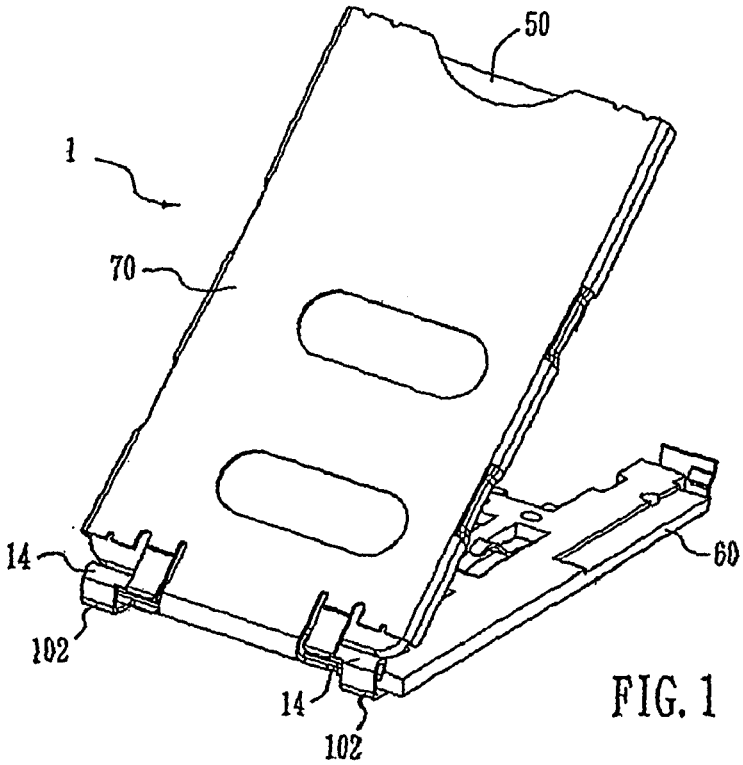
FIG. 1 is a schematic diagram of a SIM card connector of the present invention, which is in the open state.

With reference to FIG. 1, a SIM card (50) is received in a SIM card connector (1) of the present invention. The connector (1) comprises a base (60) and a cover (70).

Figure 2:
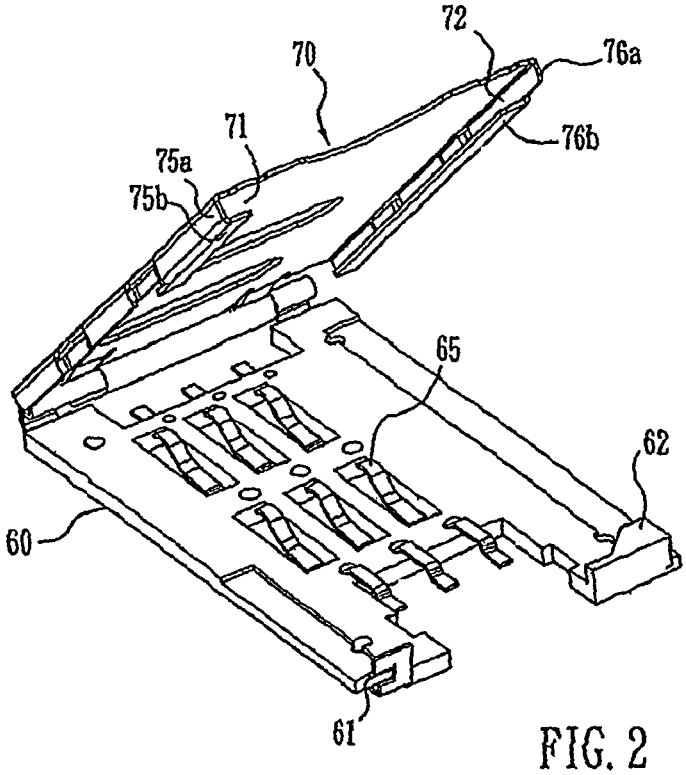
FIG. 2 is a schematic diagram of a SIM card connector of the present invention, which is in the open state.

With reference to FIG. 2, the base (60) is provided with a barb (61) at its left-front corner and a stop (62) at the right-front corner. The cover (70) has a left slot (71) at its left edge and a right slot (72) at its right edge, respectively. The left and right slots (71, 72) are formed by left and right U-shaped plates (75, 76), respectively. The U-shaped plate (75) is formed with a vertical section (75*a*) and a horizontal section (75*b*). Similarly, the U-shaped plate (76) is formed with a vertical section (76*a*) and a horizontal section (76*b*).

Figure 3:
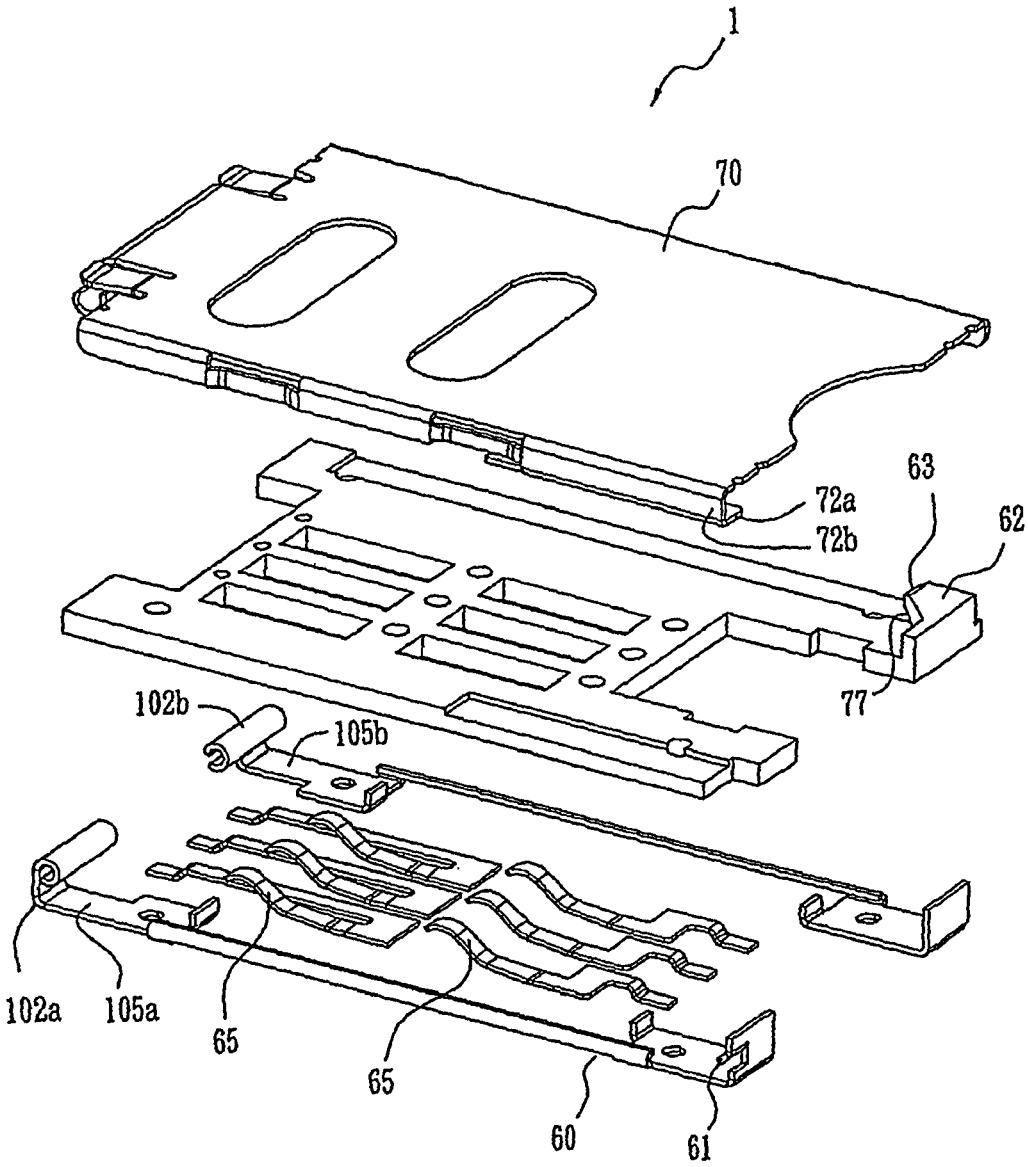
FIG. 3 is a SIM card connector of the present invention, which is in the closed state.
Figure 4:
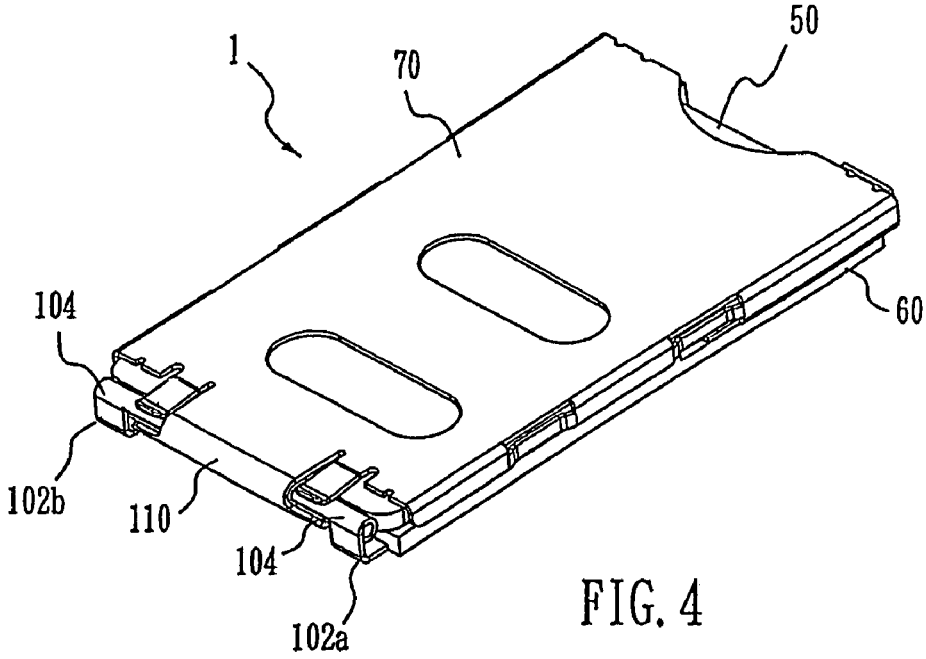
FIG. 4 shows detailed structure of a hinging portion of a SIM card connector of the present invention.

The barb (61) is used to retain the cover (70) in place when the cover (70) is in a closed position. With reference to FIG. 3, the stop (62) is provided with a slanted surface (63) to allow the horizontal section (76*b*) of the cover (70) to slip over the stop (62). A recess (77) for receiving the horizontal section (76*b*) is formed under the stop (62). A plurality of terminals (65) is mounted on the base (60). When the cover (70) with a SIM card (50) received therein is in the closed position as shown in FIG. 4, the SIM having a plurality of contacts (not shown) will contact the plurality of terminals (65).

Figure 5:
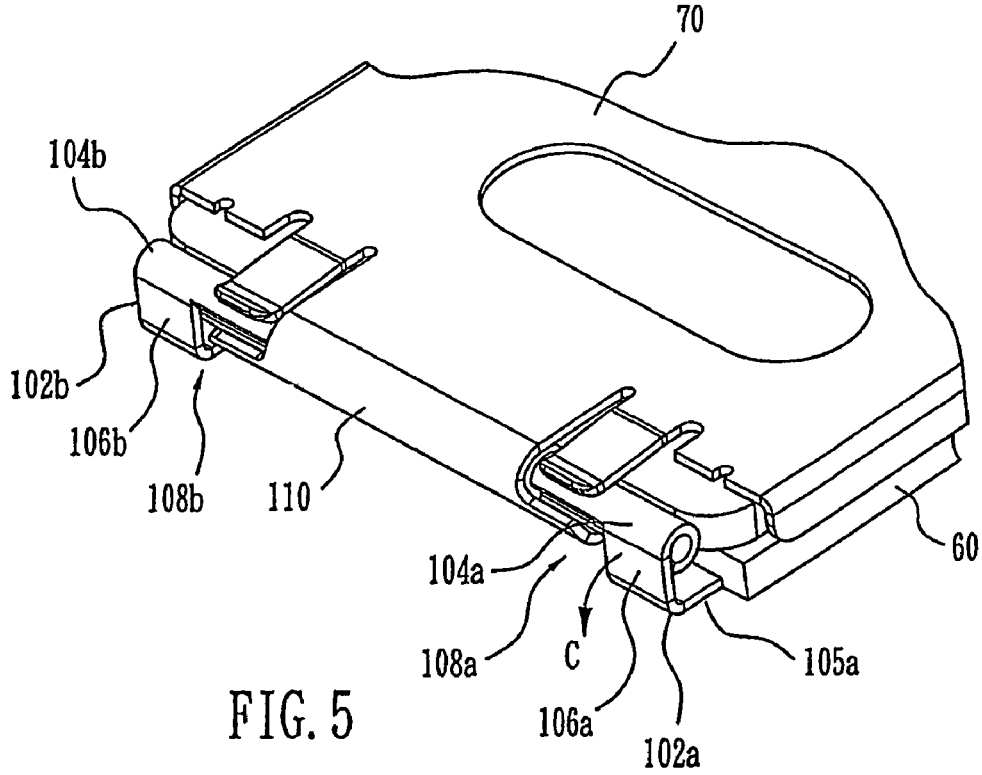
FIG. 5 is an exploded view of a SIM card connector of the present invention.

With reference to FIG. 5, the base (60) has two resilient L-shaped plates (102*a*, 102*b*) extending from the base (60). Each of the plates (102*a*, 102*b*) has a distal end at which an inner hinging portion (104*a*) is formed. The cover (70) has an outer hinging portion (110) at the intermediate portion of the rear edge of the cover (70). The outer hinging portion (110) of the cover (70) is engaged with the inner hinging portions (104*a*) of the base (60) to form a hinge (108*a*) such that the cover (70) may be pivotally mounted on the base (60). Since the plate (102*a*) is flexible, the hinge (108*a*) is deflectable from the base (60). The right hinge (108*b*) is formed as a mirror image of the left hinge (108*a*). Since the hinges (108*a*, 108*b*) are formed as mirror images, only the details of the left hinge (108*a*) are described.

To open the cover (70), the vertical portions (106*a*, 106*b*) of the base (60) will be deflected outwardly (as shown by the arrow C) such that the horizontal sections (72*a*, 76*a*) of the cover (70) are not hooked by the barb (61) and the stop (62) of the base (60) any more. The plates (102*a*, 102*b*) are made of metal.

It is appreciated that in another embodiment the two inner hinging portions (104*a*, 104*b*) can be integrated as a one-piece inner hinging portion.

The present invention is clearly described. It will be obvious that the present invention may be varied in many ways. Such variations are not to be regarded as a departure from the spirit and scope of the present invention, and all such modifications as would be obvious to one skilled in the art are intended to be included within the scope of the following claims.

What is claimed is:

1. A connector for connecting a card to a card reader, comprising:

(a) a base having a plurality of terminals for contacting the card; and (b) a cover for receiving the card;

wherein the base has at least one resilient plate extending from the base, where the at least one resilient plate has a distal end at which a first hinging portion is formed, and the cover has a second hinging portion which is engaged with the first hinging portion to form a hinge such that the cover is both pivotally mounted on the base and movable in relation to the base by resilient deflection of the at least one resilient plate.

2. The connector as claimed in claim 1, wherein the base has two of the resilient plates extending from the base, where the first hinging portions are each an inner hinging portion, and the second hinging portion is an outer hinging portion which is engaged with the inner hinging portions to form two hinges such that the cover is pivotally mounted on the base and movable in relation to the base.

3. The connector as claimed in claim 2, wherein each of the resilient plates is L-shaped such that the hinge is deflectable from the base.

4. The connector as claimed in claim 2, wherein each of the resilient plates has a horizontal portion and a vertical portion at which the inner hinging portion extends horizontally.

5. The connector as claimed in claim 1, wherein the at least one resilient plate is made of metal.

6. A card reader connector comprising:

a base having a plurality of terminals for contacting a card; and a cover movably connected to the base by a connection, where the cover is sized and shaped to receive the card, where the connection comprises:

the base having at least one resilient plate extending outward from the base, where the at least one resilient plate has a first hinging portion at a distal end of the at least one resilient plate, and the cover having a second hinging portion engaged with the first hinging portion to form a hinge, where the cover is pivotally mounted on the base at the hinge, and where the at least one resilient plate is adapted to resiliently deflect to allow the cover to move relative to the base without substantial rotational movement at the hinge by resilient deflection of the at least one resilient plate.

7. A card reader connector comprising:

a base having a plurality of terminals for contacting a card;

a cover movably connected to the base by a connection, where the connection comprises a hinge adapted to allow the cover to pivot relative to the base; and a retaining system to retain the cover in a closed position on the base, where the connection comprises at least one resiliently deflectable plate connected to the hinge and adapted to allow translation of the cover relative to the base, by resilient deflection of the at least one resiliently deflectable plate, to unlatch the retaining system and subsequently allow the cover to rotate at the hinge relative to the base.

8. A card reader connector as in claim 7 where the cover is sized and shaped to receive the card.

9. A card reader connector as in claim 7 where the hinge comprises a first hinging portion at a distal end of the at least one resiliently deflectable plate.

10. A card reader connector as in claim 9 where the hinge comprises a second hinging portion on the cover, where the first and second hinging portions are coaxially located one at least partially within the other.

* * * * *